US008480825B1

(12) United States Patent
Anderson

(10) Patent No.: US 8,480,825 B1
(45) Date of Patent: Jul. 9, 2013

(54) REMEDIATION OF FLUORINE AND CHLORINE BY-PRODUCTS IN ENERGETIC FORMULATIONS

(75) Inventor: Paul E. Anderson, Ogdensburg, NJ (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 49 days.

(21) Appl. No.: 13/227,807

(22) Filed: Sep. 8, 2011

(51) Int. Cl.
*D03D 23/00* (2006.01)

(52) U.S. Cl.
USPC ..... 149/109.6; 149/76

(58) Field of Classification Search
USPC ..... 149/76, 109.6
See application file for complete search history.

(56) References Cited

U.S. PATENT DOCUMENTS

2006/0070690 A1* 4/2006 Miller et al. ..... 149/109.6

OTHER PUBLICATIONS

Huczko et al., Synthesis of Novel Nanostructures by Metal-Polytetrafluoroethene Thermolysis, J.Phys. Chem. B 2003, 107, 2519-2524.

* cited by examiner

*Primary Examiner* — Aileen B Felton
(74) *Attorney, Agent, or Firm* — Henry S. Goldfine

(57) ABSTRACT

A method of in-situ remediation of chlorinated and fluorinated reaction by-products resulting from energetic detonations and/or burning of energetic mixtures comprising adding a quantity of Calcium disilicide ($CaSi_2$), Calcium silicide (CaSi), Magnesium disilicide ($MgSi_2$), Magnesium silicide, or Aluminum Calcium ($Al_2Ca$) compounds to the energetic mixture prior to its detonation and/or burning. Advantageously, the in-situ production of more inert by-products results from this addition thereby preventing the formation of any less-desirable by-products.

18 Claims, 2 Drawing Sheets

REMEDIATION OF FLUORINE AND CHLORINE BY-PRODUCTS IN ENERGETIC FORMULATIONS

U.S. GOVERNMENT INTEREST

The inventions described herein may be manufactured, used and licensed by or for the U.S. Government for U.S. Government purposes.

FIELD OF THE DISCLOSURE

This disclosure relates generally to the field of energetic materials. More particularly, it pertains to a method for in-situ remediation of detonation and/or burning by-products containing chlorinated or fluorinated components while maintaining system performance.

BACKGROUND OF THE DISCLOSURE

An undesirable effect of the detonation and/or burning of energetic materials is the production of by-products containing Chlorine or Fluorine. Such by-products may include acids such as HF and HCl, gases (Fluorine and Chlorine), and—if metalized energetic are used—gaseous metal fluorides. Accordingly, methods and/or systems which mitigate the production of these undesirable by-products would represent a significant advance in the art.

Recent work has shown that combustion of calcium disilicide in polytetrafluoroethene (PTFE) did form calcium fluoride (A. Huczko, H. Lange., G. Chojecki, S. Cudzilo, Y. Q. Zhu, H. W. Kroto, D. R. M. Walton, "Synthesis of Novel Nanostructures by Metal-PTFE Thermolysis", *J. Phys., Chem. B,* 2003, 107, 2519-2524). Other work shows that metal addition of metals to fluorinated binder systems show improvements in propellant systems (C. J. Fawls, J. P. Fields, K. L. Wagaman, U.S. Pat. No. 6,843,868, Jan. 15, 2005.).

Accordingly, a continuing need exists in the art for methods and/or systems which mitigate the production of undesirable detonation and/or combustion by-products.

SUMMARY OF THE DISCLOSURE

An advance in the art is made according to an aspect of the present disclosure directed to methods that provide in-situ remediation of Chlorine and Fluorine by-products. Advantageously, energetic materials formulated according to the present disclosure exhibit significant reductions in Chlorine and/or Fluorine containing compounds while maintaining their energetic and/or overall system performance. In sharp contrast to contemporary remediation methods which generally remediate after the formation/depositing of these materials, the present disclosure is an in-situ method which effectively prevents their formation at the time of reaction. Such advantages—according to an aspect of the present disclosure—are accomplished by the addition of calcium disilicide ($CaSi_2$), calcium silicide (CaSi), or other group silicides (Mg, Sr, etc.), or aluminum calcium ($Al_2Ca$) to the energetic formulation in the proper amounts and particle sizes Viewed from a first aspect, the present disclosure is directed to a method of providing in-situ remediation of Chlorine and Fluorine by-products of the detonation and/or burning of energetic mixtures by preparing the energetic mixtures such that they contain a quantity of metallic components—and in particular Calcium disilicide $CaSi_2$. Advantageously—and as a direct result of this addition—the formation of undesirable Chlorine and/or Fluorine containing by-products is substantially prevented without loss of measurable energetic effect.

BRIEF DESCRIPTION OF THE DRAWING

A more complete understanding of the present disclosure may be realized by reference to the accompanying drawings in which.

DETAILED DESCRIPTION

Figure 1:
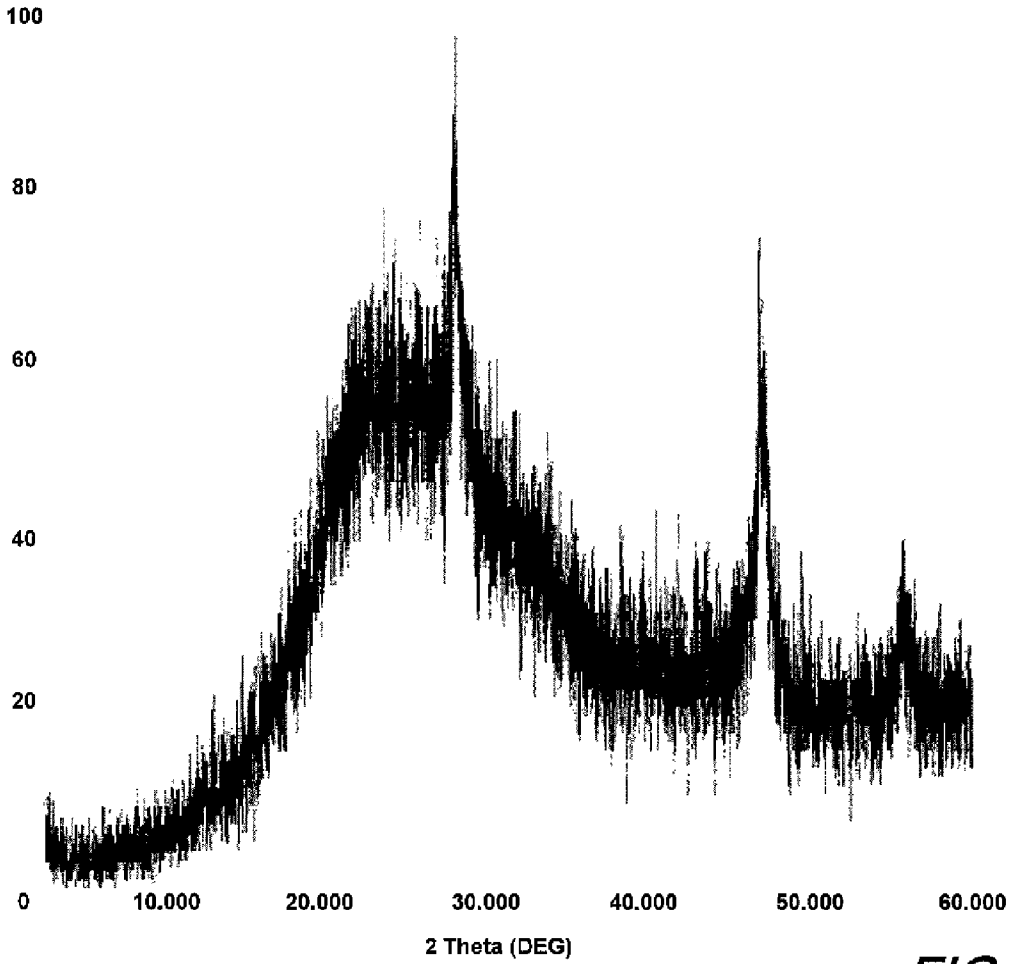
FIG. 1 is a plot of an X-Ray diffraction analysis of a power residue from combustion of a formulation according to an aspect of the present disclosure.

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently-known equivalents as well as equivalents developed in the future, i.e., any elements developed that perform the same function, regardless of structure.

By way of some additional background, it is noted that the use of fluorinated binder systems in explosive, pyrotechnic, and propellant applications are energetically-beneficial due—in part—to the highly oxidative nature of the fluorine atom. Chlorinated binder systems have also been used in energetic formulations resulting in similar enhancements in performance. One such chlorinated binder system which has found widespread use in explosive and propellant systems is ammonium perchlorate (AP).

More recently, concerns about the environmental effects/impacts of these chlorinated or fluorinated compounds have arisen. Consequently, attempts to remediate Chlorine and/or Flourine containing reaction by-products have been undertaken.

And while much contemporary literature discusses bioremediation and other remediation efforts of these by-products, nothing is reported regarding the in-situ prevention of their formation. Advantageously, the present disclosure addresses this deficiency in the art.

With this background in place, it is known to those skilled in the art of pyrotechnics that burning metals with fluorinated binders, such as magnesium and Teflon, produce magnesium fluoride:

$$Mg + —[C_xF_y]— \rightarrow MgF_2 + CO_2 + heat$$

Accordingly, if one could apply these reaction principles to chlorinated and/or fluorinated energetic systems, then reaction by-products exhibiting a greater (more favorable) inertness may be produced. While arguably intuitively obvious, it is nevertheless a perplexing challenge is to obtain the reaction of the metal fluoride (as in the above example) at rates that can be used in energetic mixtures such as high explosives and/or propellants, where pressure rise times and reaction rates oftentimes exceed the burn propagation front with speeds approaching and/or exceeding the speed of sound.

More recently, a number of aluminized explosives have been produced that show evidence of an aluminum reaction within a short timeframe characteristic of a detonation event. These aluminized explosives are generally referred to as "combined effects" explosives, where the metal pushing ability (Gurney constant) is nearly the same as highly loaded nitramine formulations without the aluminum additive while also exhibiting a sufficiently high blast.

According to an aspect of the present disclosure then, a metal additive is formulated with energetic materials such that it reacts upon the rapid pressure/temperature rise of detonation/ignition and preferentially forms certain reactive by-products. Caclium disilicide $CaSi_2$ is one example of such an additive according to the present disclosure and it advantageously binds the Fluorine and Chlorine toxic by-products with the silicon while not significantly degrading the energetic output.

EXAMPLES

Example 1

A combustion study of $CaSi_2$ in Viton binder was used to evaluate the feasibility of calcium chloride formation during a burning event. 0.69 g of Viton was dissolved in acetone to which 0.55 g of $CaSi_2$ was added. The mixture was stirred and acetone slowly evaporated. The dried solids were placed in a ceramic crucible (0.872 g) and combusted in a furnace preheated at 800° C. and then ramped to 950° C. for 1 hour. The solids collected were 0.619 g of grey and white material. The material was digested in sulfuric acid and the liquid tested for fluorine ions. It was calculated that the sample contained about 7% calcium fluoride. While only performed at the combustion level at atmospheric pressure, this test confirmed the formation of calcium fluoride. It is anticipated that at higher pressures and temperatures of a detonation event will further drive the oxidation of calcium with fluorine to completion.

Example 2

A study using LX-07 (10% Viton/90% HMX) was performed using Cheetah 5.0 thermochemical code and the bkws library. Upon optimization by statistical design of experiments, it was found that a formulation of 10% Viton/83% HMX/7% calcium silicide, HF in the final combustion products was advantageously reduced by nearly 300 times. For lkg of explosive, this brings the level of potential free HF in the reaction by-products to below 3 ppm at equilibration with atmospheric pressure and room temperature, which is within the OSHA permissible limit value (PML) for HF. A product analysis of the Cheetah detonation is shown below in Table 1.

TABLE 1

Product analysis from Cheetah analysis of detonation

| | Performance and detonation products (mol/kg) at full combustion | | | | | |
|---|---|---|---|---|---|---|
| Formulation | CJ (Mpa) | Detonation velocity (km/s) | Total Energy (kJ/mol) | HF | $CAF_2$ | $SiO_2$ |
| LX-07 | 33.88 | 8.82 | 10.542 | 0.03473 | — | — |
| 83% HMX/10% Viton/7% $CaSi_2$ | 34.61 | 9.05 | 11.441 | 0.0001 | 0.0103 | 0.0068 |

Silicon tetrafluoroide ($SiF_4$) was also a detonation product at 0.0035 mol/kg, which translates to 1000 ppm. Further increasing the amount of $CaSi_2$ in the formulation does lead to nearly an order of magnitude decrease in the amount of this toxic chemical and a corresponding increase in amount of $SiO_2$.

Of particular note is the increase in detonation velocity, Chapman-Jougot (CJ) pressure, and total energy of the detonation event. This is due to the highly exothermic formation of calcium fluoride, assuming this compound is formed in the detonation reaction zone. Considering the melting point of calcium disilicide is on the order of about 1070° C., and it readily reacts with air by 800° C., it is likely this reaction would occur at volume expansions <15 $V/V_o$.

A formulation from this Example 2 was made on the 50 gram scale. The dry ingredients were slowly added to a solution of Viton A dissolved in methyl ethyl ketone while mixing in a Ross ½ pint mixer with counter rotating blades. The granules were dried overnight at 60° C. in a vacuum oven, and then pressed into a small pellet and combusted in a Parr 1590 Semi-micro combustion calorimeter.

The solid products from the burn event were analyzed in a Rigaku Miniflex x-ray diffractometer (XRD). Peaks consistent with calcium fluoride were identified at 2θ=28.6°, 47°, and 56.8° (FIG. 1). The small broad peak size is consistent with either nanocrystalline domains or amorphous structure, most likely carbon centered at ~25.

Example 3

Two 50 g batches of explosive were made; one with Viton A, RDX, and calcium disilicide and the other without calcium disilicide. The materials were mixed in a slurry of Viton A in MEK and slowly evaporated while mixing in a Ross planery blade Pint Mixer.

Figure 2:
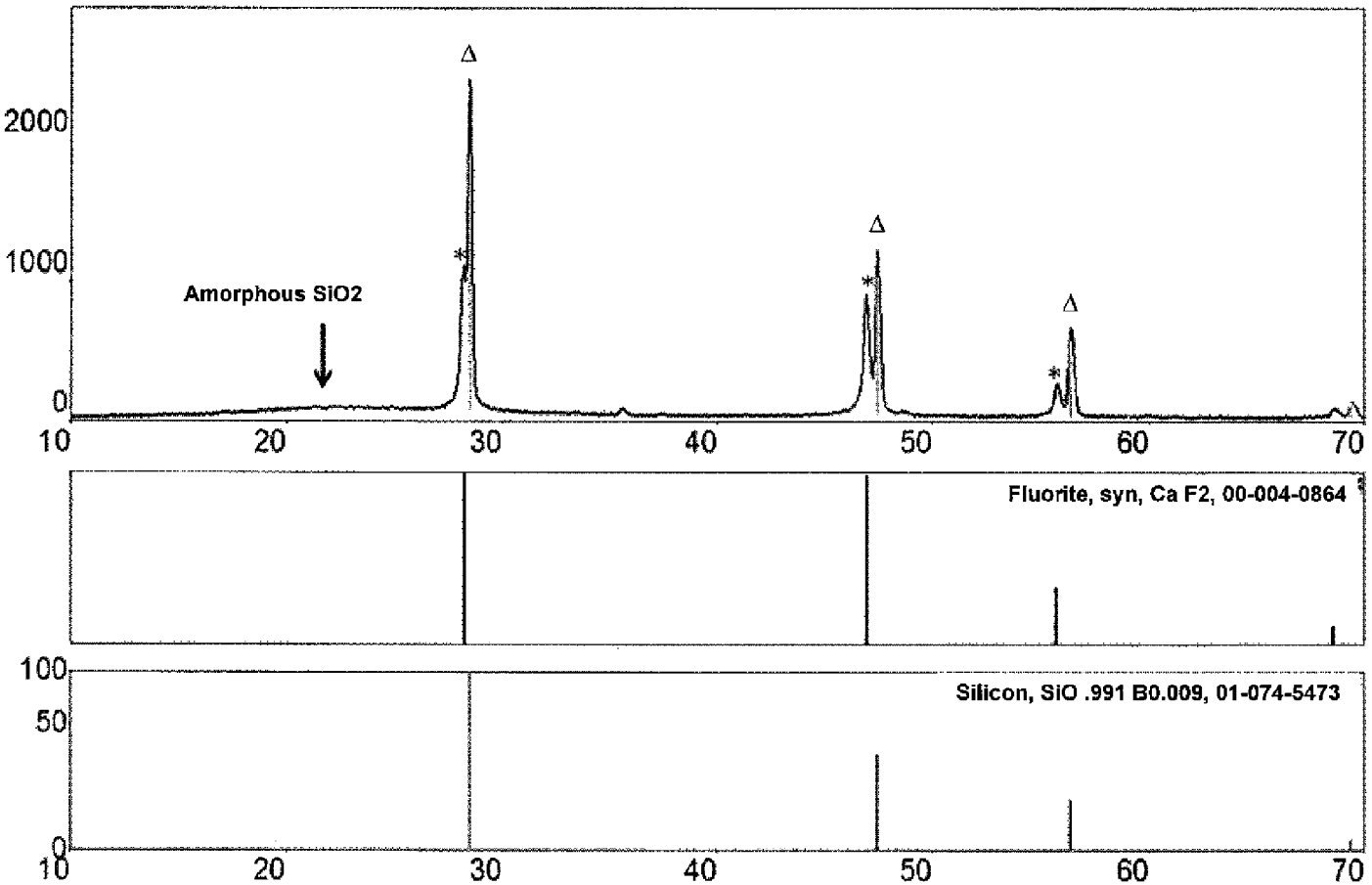
FIG. 2 is a plot showing detonation product residue from Calcium disilicide impregnated explosive experiments wherein * denote $CaF_2$ peaks and Δ denotes silicon peaks.

The two energetic formulations were tested in a closed bomb detonation. Both formulations included a nitramine, fluorinated binder and burn suppressant, however one contained $CaSi_2$. After detonation of the samples both solid and off gasses were analyzed. The HF was collected in a polyethylene loop cooled in a liquid nitrogen/ethanol bath and the gases bubbled through ice water. The tubing was thoroughly rinsed and combined with the ice water and analyzed with anion chromatography. Results of HF formation are summarized in Table 2. As can be seen the Percent Theoretical HF production was reduced by nearly 30 percent with the presence of $CaSi_2$. The theoretical HF production is calculated such that all F in the binder is converted to HF as an end product which yields a theoretical maximum amount. XRD was run on the solid residues which confirmed the formation of $CaF_2$ (FIG. 2).

TABLE 2

Detonation products analysis from two formulations one with and one without calcium disilicide

| Sample Identification | Mass of Sample (g) | Theoretical HF Production (mg) | Total HF Production (mg) | Percent Theoretical HF Produced |
|---|---|---|---|---|
| Formulation WithOut $CaSi_2$ | 6.0318 | 1257.0 | 758.7 | 60.36 |
| Formulation With $CaSi_2$ | 5.7927 | 1005.6 | 421.3 | 41.89 |
| Formulation With $CaSi_2$ | 5.7059 | 990.54 | 418.1 | 42.21 |

At this point, while we have discussed and described exemplary embodiments directed to methods and compositions for the remediation of Chlorine and Fluorine by-products of energetic reactions. And while the exemplary compositions have been disclosed, those skilled in the art will appreciate that the techniques and compositions according to the present disclosure are not so limited. For example, numerous chlorine and/or fluorine containing binder systems are anticipated as benefiting from the present disclosure. More particularly, it is anticipated that Calcium disilicide employed will include a quantity of one or more of the following impurities, i.e., iron, iron silicide, free silicon, and carbon. No negative effects from their inclusion are anticipated. In addition, in a preferred embodiment the Calcium disilicide will advantageously exhibit an average particle size varying from 0.01 microns to 1000 microns. Consequently, no special Calcium disilicide is required to practice the disclosure. In addition, silicides/disilicides of Magnesium as well as AluminumCalcium (AlCa2) compositions are contemplated by the present disclosure in a similar manner to those described with respect to Calcium compositions. This includes impurities, like compounds and particle sizes—to name a few.

And while we have generally use the terminology of energetic mixtures, those skilled in the art will appreciate that such energetic mixtures may include high explosives, propellants and/or thrusters as those terms are generally known and used in the art. Finally, the energetic mixtures may comprise one or more known halogenated monomers, polymers, waxes, or elastomers as well as quantities of known chlorine and/or fluorine containing compounds used in the energetic arts including—but not limited to—ammonium perchlorate, potassium perchlorate, ammonium chlorate, potassium chlorate, sodium perchlorate and sodium chlorate. It was noted in the art that by addition of calcium disilicide to energetic formulations containing fluorinated and chlorinated binder systems or ammonium perchlorate that the toxic by-products upon reaction are substantially reduced or eliminated. Additionally, the useful work energy of the system, either in propellants, thrusters, or high explosives, remains with little or no loss in performance responses provided the rate of calcium disilicide reaction is such that the reaction enthalpy to calcium chloride or fluoride is realized within the timeframes of the desired reaction. This can vary from microseconds for secondary high explosive formulations to milliseconds for propellant and thruster applications. Such performance remains in spite of the loss of energetic moieties due to the high heats of formation of calcium fluorides or chlorides which further promotes gas expansion.

Accordingly, the present disclosure should only be limited by the scope of the claims that follow.

The invention claimed is:

1. A method for the in-situ remediation of chlorine and fluorine by-products resulting from the combustion/detonation of and energetic mixture comprising the steps of:

adding to the energetic mixture prior to its combustion/detonation a quantity of a Calcium-containing material such that upon combustion/detonation undesirable halogenated by-product production is reduced;

wherein the Calcium-containing material is one selected from the group consisting of Calcium disilicide ($CaSi_2$) and Calcium silicide (CaSi).

2. The method according to claim 1 wherein said Calcium-containing material quantity includes one or more of the following: iron, iron silicide, free silicon, and carbon.

3. The method according to claim 1 wherein said Calcium-containing material exhibits an average particle size varying from 0.01 microns to 1000 microns.

4. The method according to claim 1 wherein said energetic mixture is one selected from the group consisting of high explosives, propellants, and thrusters.

5. The method according to claim 1 wherein said energetic mixture includes halogenated (fluorinated or chlorinated) monomers, polymers, waxes, or elastomers.

6. The method according to claim 1 wherein said energetic mixture comprises one selected from the group consisting of: ammonium perchlorate, potassium perchlorate, ammonium chlorate, potassium chlorate, sodium perchlorate and sodium chlorate.

7. A method for the in-situ remediation of chlorine and fluorine by-products resulting from the combustion/detonation of and energetic mixture comprising the steps of:

adding to the energetic mixture prior to its combustion/detonation a quantity of a Magnesium-containing material such that upon combustion/detonation undesirable halogenated by-product production is reduced;

wherein the Magnesium-containing material is one selected from the group consisting of Magnesium disilicide ($MgSi_2$) and Magnesium silicide (MgSi).

8. The method according to claim 7 wherein said Magnesium-containing material quantity includes one or more of the following: iron, iron silicide, free silicon, and carbon.

9. The method according to claim 7 wherein said Magnesium-containing material exhibits an average particle size varying from 0.01 microns to 1000 microns.

10. The method according to claim 7 wherein said energetic mixture is one selected from the group consisting of high explosives, propellants, and thrusters.

11. The method according to claim 7 wherein said energetic mixture includes halogenated (fluorinated or chlorinated) monomers, polymers, waxes, or elastomers.

12. The method according to claim 7 wherein said energetic mixture comprises one selected from the group consisting of: ammonium perchlorate, potassium perchlorate, ammonium chlorate, potassium chlorate, sodium perchlorate and sodium chlorate.

13. A method for the in-situ remediation of chlorine and fluorine by-products resulting from the combustion/detonation of and energetic mixture comprising the steps of:

adding to the energetic mixture prior to its combustion/detonation a quantity of Aluminum Calcium ($Al_2Ca$) material such that upon combustion/detonation undesirable halogenated by-product production is reduced.

14. The method according to claim 13 wherein said Aluminum Calcium material quantity includes one or more of the following: iron, iron silicide, free silicon, and carbon.

15. The method according to claim 13 wherein said Aluminum Calcium material exhibits an average particle size varying from 0.01 microns to 1000 microns.

16. The method according to claim 13 wherein said energetic mixture is one selected from the group consisting of high explosives, propellants, and thrusters.

17. The method according to claim 13 wherein said energetic mixture includes halogenated (fluorinated or chlorinated) monomers, polymers, waxes, or elastomers.

18. The method according to claim 13 wherein said energetic mixture comprises one selected from the group consisting of: ammonium perchlorate, potassium perchlorate, ammonium chlorate, potassium chlorate, sodium perchlorate and sodium chlorate.

* * * * *

UNITED STATES PATENT AND TRADEMARK OFFICE

CERTIFICATE OF CORRECTION

PATENT NO. : 8,480,825 B1
APPLICATION NO. : 13/227807
DATED : July 9, 2013
INVENTOR(S) : Paul E. Anderson It is certified that error appears in the above-identified patent and that said Letters Patent is hereby corrected as shown below:

Title Page Item (73), Assignee: "Navy" should read --Army--.

Signed and Sealed this
Third Day of September, 2013

Teresa Stanek Rea
*Acting Director of the United States Patent and Trademark Office*